US009096363B2

(12) United States Patent
Reynard

(10) Patent No.: US 9,096,363 B2
(45) Date of Patent: Aug. 4, 2015

(54) LOAD CARRYING PLATFORM

(75) Inventor: Kenneth Reynard, Thirsk (GB)

(73) Assignee: DURALOC LIMITED, North Yorkshire (GB)

( * ) Notice: Subject to any disclaimer, the term of this patent is extended or adjusted under 35 U.S.C. 154(b) by 1002 days.

(21) Appl. No.: 13/000,316

(22) PCT Filed: Jun. 2, 2009

(86) PCT No.: PCT/GB2009/050606

§ 371 (c)(1),
(2), (4) Date: Mar. 21, 2011

(87) PCT Pub. No.: WO2009/153586

PCT Pub. Date: Dec. 23, 2009

(65) Prior Publication Data

US 2011/0155025 A1 Jun. 30, 2011

(30) Foreign Application Priority Data

Jun. 20, 2008 (GB) ..... 0811290.6

(51) Int. Cl.
*B65D 88/00* (2006.01)
*B65D 88/12* (2006.01)
*B65D 88/52* (2006.01)

(52) U.S. Cl.
CPC ..... *B65D 88/129* (2013.01); *B65D 88/522* (2013.01)

(58) Field of Classification Search
CPC .. B65D 7/26; B65D 11/1873; E05D 11/1042; E05D 11/1028
USPC ..... 108/55.1, 51.11, 53.1, 54.1, 56.1; 248/346.3, 346.02, 346.01; 403/93, 94, 403/95; 220/1.5, 6, 666, 4.28; 16/334, 335, 16/342
See application file for complete search history.

(56) References Cited

U.S. PATENT DOCUMENTS

| | | | | |
|---|---|---|---|---|
| 553,650 | A * | 1/1896 | Kingsland | 403/353 |
| 1,066,155 | A * | 7/1913 | Sayer | 125/43 |
| 3,547,054 | A * | 12/1970 | Caldwell et al. | 108/115 |
| 5,639,174 | A * | 6/1997 | Gonska | 403/103 |

(Continued)

FOREIGN PATENT DOCUMENTS

| | | | |
|---|---|---|---|
| GB | 2211169 | A * | 6/1989 |
| GB | 2212478 | | 7/1989 |

(Continued)

OTHER PUBLICATIONS

International Search Report in International Application No. PCT/GB2009/050606; mailed Aug. 31, 2009; 3 pages.

*Primary Examiner* — Kimberly Wood
(74) *Attorney, Agent, or Firm* — Howard & Howard Attorneys PLLC

(57) ABSTRACT

A transportable load carrying platform comprising a base to support a load during transportation. One or a plurality of support frames are positioned towards one or two ends of base and are configured to pivot between three positions. In a first position, the end frames extends upwardly from the base, in a second position the end frames extend outwardly and downwardly from the base and in a third position the end frames are substantially flat and parallel to the base to reduce the overall height of the platform. Pivot means allow the support frames to pivot relative to the base between the various positions. Suitable load transfer means are provided to effectively transfer any applied loading forces from the support frames to the base.

13 Claims, 6 Drawing Sheets

(56) References Cited

U.S. PATENT DOCUMENTS

| | | | | |
|---|---|---|---|---|
| 5,755,472 | A | 5/1998 | Clive-Smith | |
| 2004/0045963 | A1 * | 3/2004 | Hoogland | 220/6 |
| 2010/0043677 | A1 * | 2/2010 | Reynard | 108/55.1 |
| 2010/0270298 | A1 * | 10/2010 | Kong et al. | 220/4.29 |
| 2010/0294785 | A1 * | 11/2010 | Massa | 220/666 |

FOREIGN PATENT DOCUMENTS

| | | | |
|---|---|---|---|
| GB | 2295381 | A | 5/1996 |
| JP | 55006250 | U | 1/1980 |
| WO | 2004106678 | A1 | 12/2004 |
| WO | 2007085801 | A | 8/2007 |
| WO | WO 2007085801 | A1 * | 8/2007 |

* cited by examiner

LOAD CARRYING PLATFORM

REFERENCE TO RELATED APPLICATIONS

This application is a PCT National Stage Application based on PCT International Application No. PCT/GB2009/050606 filed Jun. 2, 2009, which claims priority to GB Patent Application No. 0811290.6 filed Jun. 20, 2008.

TECHNICAL FIELD

The present invention relates to a transportable load carrying platform configured to support loads to be transported, and in particular, although not exclusively, to a load carrying platform having a base and at least one support frame pivotally mounted at the base and configured to adopt three different positional configurations.

BACKGROUND OF THE INVENTION

A transportable load carrying platform of the type with which the invention is concerned is referred to generally in the art, namely the field of freight transport, as a "folding end flat rack", and which has been made and used for many years for transport/shipping of heavy or irregular shaped cargo which cannot be loaded into a normal ISO shipping container. Usually, the load is lashed down to a base frame of the platform, and the platform is transported with a pair of end walls in an operative upright position. The platform is capable of being handled readily in this manner, including transit to a dock, transfer to a ship and onward sailing to the port of destination, transfer again to a vehicle or rail wagon, and transit to final destination. Alternatively, the load can be transferred at the port to a suitable load carrier for final transport to the eventual destination. In either event, for the return empty journey of the platform, the end walls may be folded downwardly to inoperative positions, so that stacks of unloaded platforms or "racks" can be formed and locked together for efficient transport.

The end walls are usually pivotally mounted at the ends of the base frame, and are locked in their operative positions. The locking of the end walls in the operative positions usually is obtained by operation of "shoot bolts" or the like which are mounted on the base frame, a small distance only above the pivots on which the end walls are mounted, and which are slid into receiving holes provided in the end walls after the walls have been pivoted upwardly through approximately 90° from the inoperative positions.

WO 02004/106678 discloses a hinge assembly for a flat rack platform configured to mount a pair of end walls to a base frame to contain cargo during shipping.

GB 2211169 discloses a platform based shipping container comprising folding corner posts that allow end walls to move between an operative position to contain the transported loads and an inoperative position in which the end walls lay flat on top of the base so as to reduce the overall height of the container for ease of stacking and transportation between shipping operations.

WO 2007/085801 discloses a transportable load carrying platform comprising two end walls pivotally mounted on a base frame. The end walls pivot relative to the base via an eccentric pivot arrangement that allows an additional displacement of the end walls forming part of the movement from operative to inoperative positions.

However, conventional load carrying platforms of the type identified above, whilst providing secure and convenient transport containers, are not always convenient with regard to the loading and unloading of transported goods. For example, the folding end walls may hinder the loading and unloading of goods to and from the transport platform.

The inventors therefore have realised a need for an improved load carrying platform that, satisfies the load bearing requirements of the transportable container whilst allowing goods to be readily loaded and unloaded between shipping operations.

SUMMARY

According to a first aspect of the present invention there is provided a transportable load carrying platform comprising: a base to support a load; at least one support frame pivotally mounted towards one end of the base, the at least one support frame configured to pivot between at least three positions comprising: a first operative position in which the support frame extends upwardly and transverse to the base; a second operative position in which the support frame extends outwardly and downwardly from the base; and an inoperative position in which the support frame extends substantially parallel to the base so as to reduce the overall high of the platform; a pivot means to mount the support frame at the base and to allow the support frame to pivot between the three positions about a pivot axis; displacement means to allow the support frame to be displaced laterally relative to the pivot axis; cooperative load carrying means provided at the base and the support frame configured to engageably cooperate when the support frame is maintained in the first operative position, the cooperative load carrying means configured to transfer loading forces from the support frame to the base; wherein displacement of the support frame to and from the first operative position in which the load carrying means are cooperatively engaged comprises pivotal movement about the pivot axis and lateral displacement of the support frame relative to the pivot axis.

Preferably, the base and the single or pair of end support frames (end walls) are pivotally coupled via intermediate support arms, (connected to the support frame) and pivot mountings (connected to the base). Reference within the specification to relative movement of the support frame relative to the base includes relative movement of the support arms and pivot mountings. Additionally, the support frame is considered to comprise the support arms which may be formed integrally and non-integrally with the main body of the support frame. Similarly, the base is considered to comprise the pivot mountings that may be formed integrally or non-integrally with the main body of the base.

Preferably, the platform further comprises a pivot pin extending through a region of the base and a corresponding region of the support frame. In particular, this pivot pin extends through each respective pivot mounting and support arms as described in detail below.

Preferably, the pivot pin forms part of an eccentric arrangement which is rotatable so as to laterally displace the support frame relative to the pivot axis so as to provide engagement and release of the cooperative load carrying means provided at the base and support frame. The eccentric arrangement may comprise a cam, this cam mounting the support frame about the pivot pin. Preferably, the cam is rotatably mounted at the support frame and in particular the support arms connecting the support frame to the base.

Preferably, the platform comprises first and second load cooperative means provided at the base and the support frame, the first and second load carrying means being spaced apart so as to distribute the loading forces effectively. So as to achieve optimum load transfer from the end support frames to the base, the first and second load carrying means are spaced in the upward (substantially vertical) direction when each support frame is orientated in the upward (substantially vertical) orientation relative to the base.

Preferably, the second load carrying means of the support frame comprises a pair of lugs and the corresponding second load carrying means of the base comprises a pair of troughs configured to receive the respective pair of lugs. Similarly, the first load carrying means of the support frame comprises a lug extending from a cross-strut extending between the support arms and the corresponding first load carrying means of the base comprises a trough formed at an upper end of the pivot mounting. The load carrying action is provided by engagement of the lug in the trough and abutment of the cross-strut onto the upper end of the pivot mounting. As will be appreciated, the lug and trough arrangement may be reversed such that troughs are provided on the support frame (support arms) whilst the lugs are formed on the base (pivot mountings).

Preferably, the base (in particular the pivot mountings), comprise a first abutment surface to engage and support the support frame (in particular the support arms) in the second operative position. Additionally, the base may comprise a second abutment surface to engage and support the support frame in the inoperative position in the same manner as the first abutment surface. So as to allow the end support frames to extend outwardly and in a downward direction away from the base, the first abutment surface is aligned transverse to the second abutment surface and in particular an upward facing surface of the base.

Optionally, means are provided to rotate the eccentric arrangement at the support arms of the end frames so as to laterally displace the end frames relative to the pivot pin and in particular the pivot axis extending longitudinally through the pivot pin.

BRIEF DESCRIPTION OF THE DRAWINGS

A specific implementation of the present invention will now be described by way of example only and with reference to the accompanying drawings, in which.

DETAILED DESCRIPTION OF THE EXEMPLARY EMBODIMENT(S)

The load carrying platform 10 comprises a base 11 for supporting a load (not shown), such load being a large piece of machinery, or irregular cargo, not capable of being shipped in a standard ISO container. The load is typically lashed-down firmly to the base so as to avoid it becoming dislodged during transportation.

The platform 10 further comprises two end frames 12 (or end walls) mounted one at each of the two opposed ends of base 11 and operative to be pivotally and laterally displaced between the three positions A, B, C.

Figure 1C:
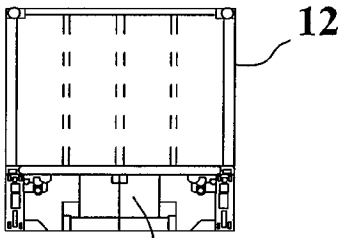
FIGS. 1*a*, 1*b* and 1*c* are respectively, plan, side and front elevation views of the present load carrying platform according to a specific implementation.
Figure 1D:
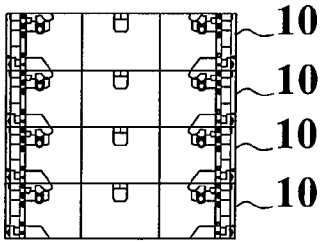
FIG. 1*d* is front/rear elevation view of a plurality of load carrying platforms of FIG. 1*b* stacked on top of one another.
Figure 1B:
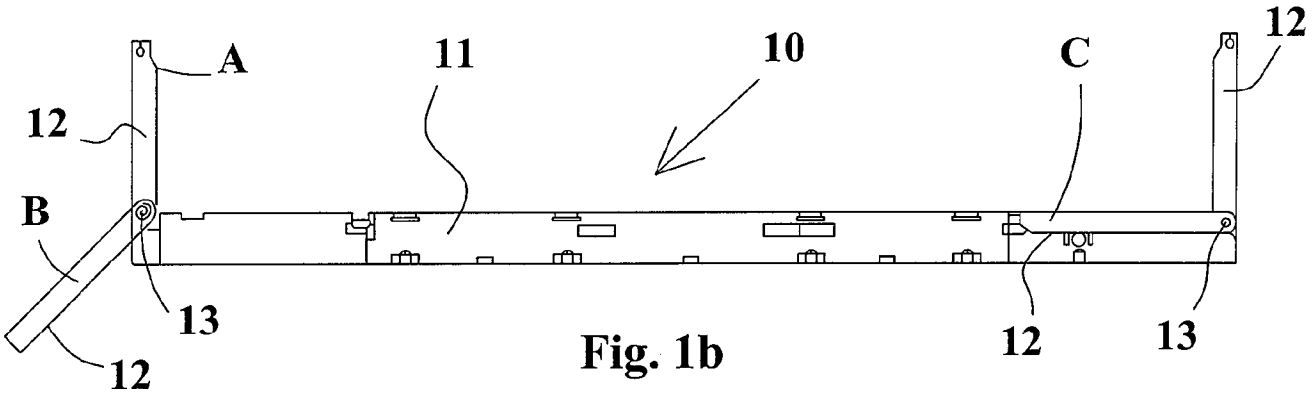
Figure 1A:
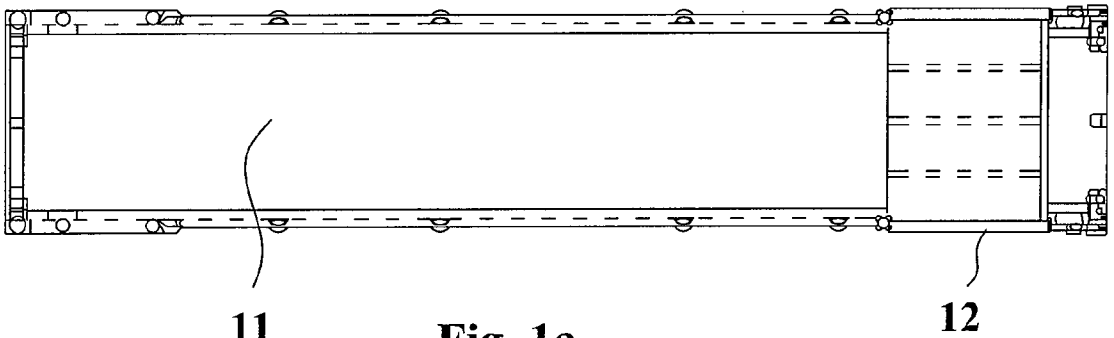

In the first operative position A, support frame 12 is aligned upwardly from and perpendicular to base 11. In the second operative position B, support frame 12 extends outwardly and downwardly from base 11 so as to form an inclined ramp. In the third position C, support frame 12 is aligned parallel with the base 11 to reduce the overall height of platform 10 to provide convenient storage when not in use to transport cargo. As illustrated in FIG. 1*d*, with the support frames 12 orientated in position C, a plurality of platforms 10 may be stored one on top of another in a compact arrangement to reduce the volume of platforms when in storage between shipping operations.

Figure 2:
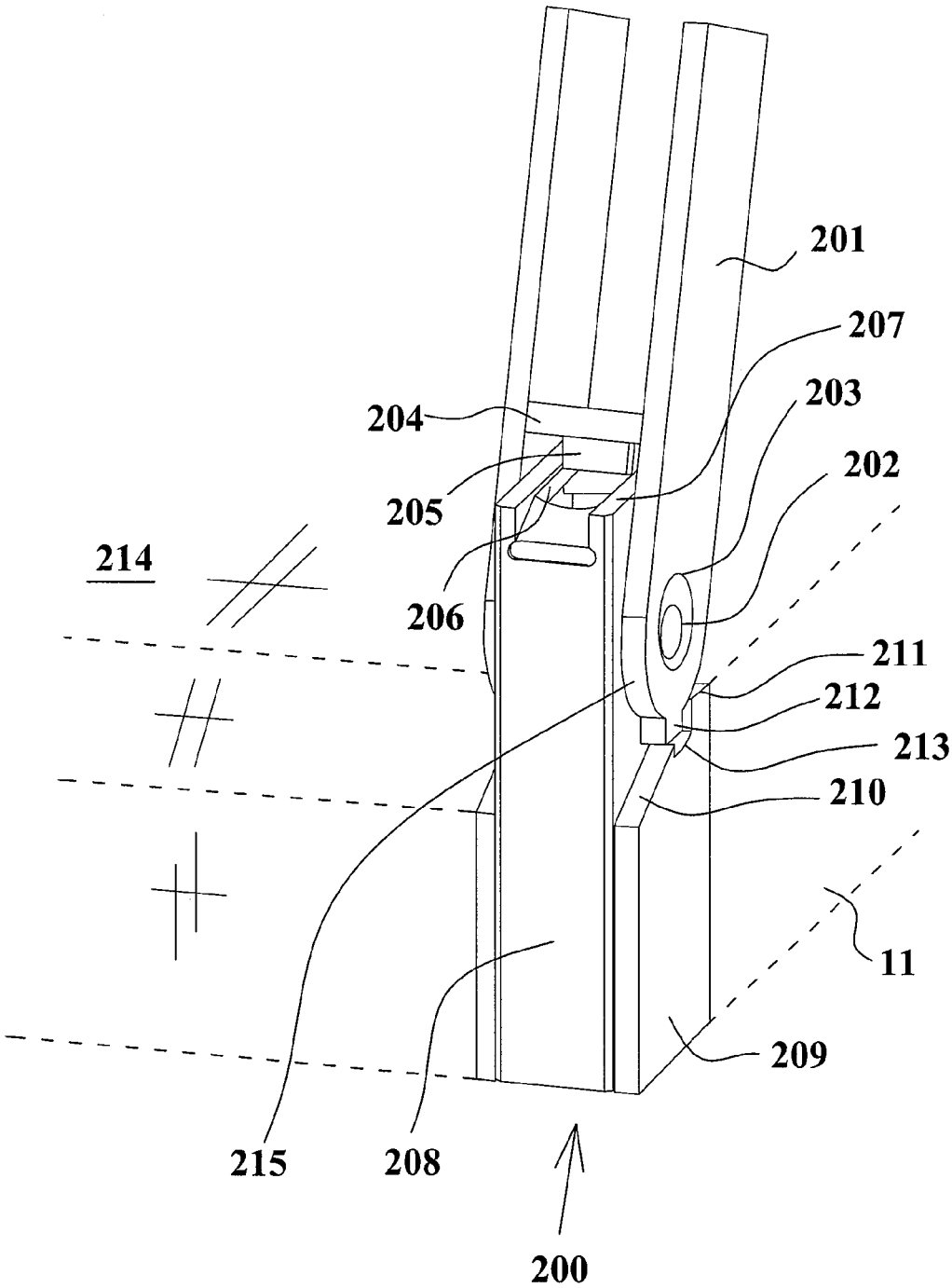
FIG. 2 is a perspective view of a hinge assembly via which the support frames are mounted on the base of FIGS. 1*a* to 1*d;*

Referring to FIG. 2, platform 10 comprises a pair of hingable joints 200 positioned at each corner of the substantially elongate and rectangular base 11. Each joint comprises a pivot mounting formed by an elongate stanchion 208 having a flared lower region 209 that is secured to base 11. Stanchion 208 is aligned perpendicular to the plane of base 11 and extends above an upper surface 214 of base 11.

The uppermost region of flared base region 209 defines a first abutment surface 211 aligned substantially parallel and in the same plane as upper surface 214. A second abutment surface 210 is also provided at region 209 extending transverse and at an inclined angle relative to upper surface 214 so as to slope downwardly away from surface 214 and abutment surface 211.

A trough like cavity 206 is provided at an uppermost end 207 of stanchion 208, trough 206 extending into the main length of stanchion 208. Stanchion 208 further comprises a suitable through-bore (not shown) mounting a rotatable pivot pin 202 extending through stanchion 208. Two support arms 201 mount the support frame 12 at the pivot mounting joint 200 and accordingly base 11. Support arms 201 extend either side of stanchion 208 and are mounted at pivot pin 202 extending a small distance from either side of stanchion 208.

Support arms 201 are mounted at pivot pin 202 via an eccentric mounting arrangement 203 to form a cam. The cam insert 203 comprises a substantially disk-like structure having a bore to receive one end of pivot pin 202. Each support arm 201 is mounted via the disk-like cam arrangement 203 towards one end of its elongate length.

The pin mounted end of each support arm 201 comprises a rounded edge profile 215 such that in plan view, the outmost edge of each support arm 201 at the mounted end defines a semi-circle. A lug 212 extends (from each of the two support arms 201) from the curved edge 215 positioned offset from a central longitudinal bisecting line.

A cross strut 204 is provided between the pair of support arms 201 at a distance from curved edge 215 sufficient to clear the uppermost end 207 of stanchion 208 as arms 201 are pivoted about pin 202. A lug 205 extends from a downward facing surface of cross strut 204 and is configured to be received by trough 206 when support arms 201 are displaced laterally in a downward direction towards flared region 209. Similarly, flared region 209 comprises a pair of troughs 213 configured to receive the pair of lugs 212 following this downward lateral displacement of arms 201 (and support frame 12).

Figure 3A:
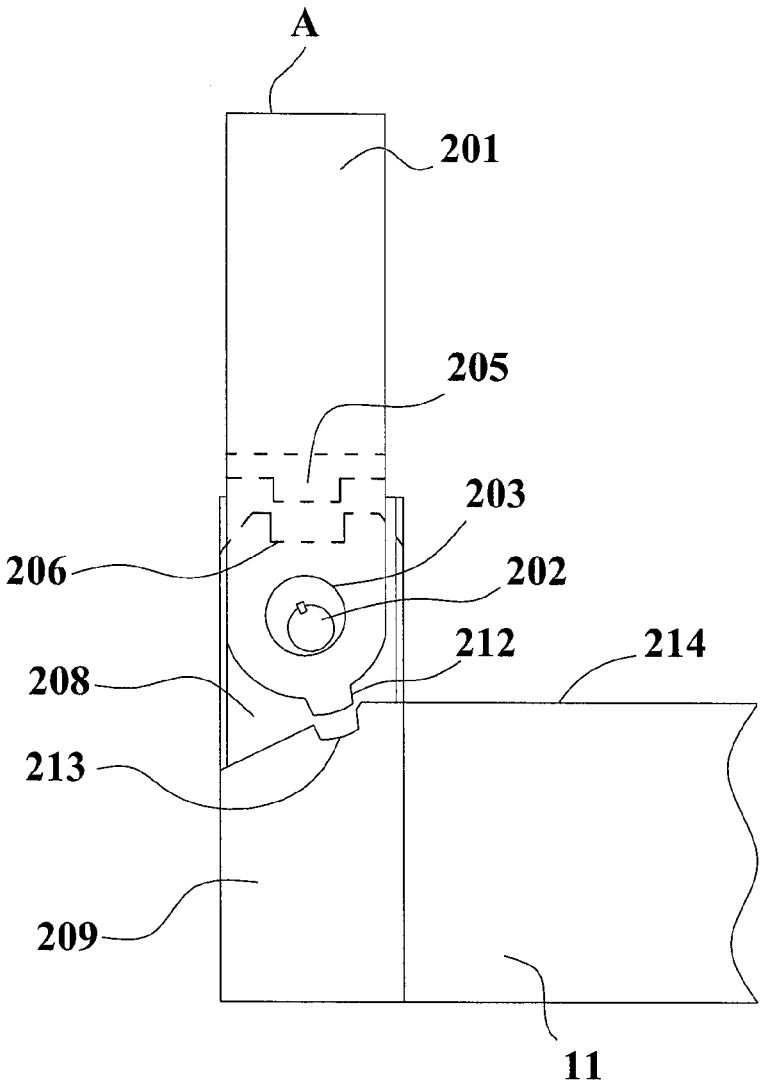
FIG. 3*a* is a side elevation view of the joint assembly of FIG. 2 with the support frame in a first operative position arranged perpendicular to the base in an unlocked orientation.
Figure 3B:
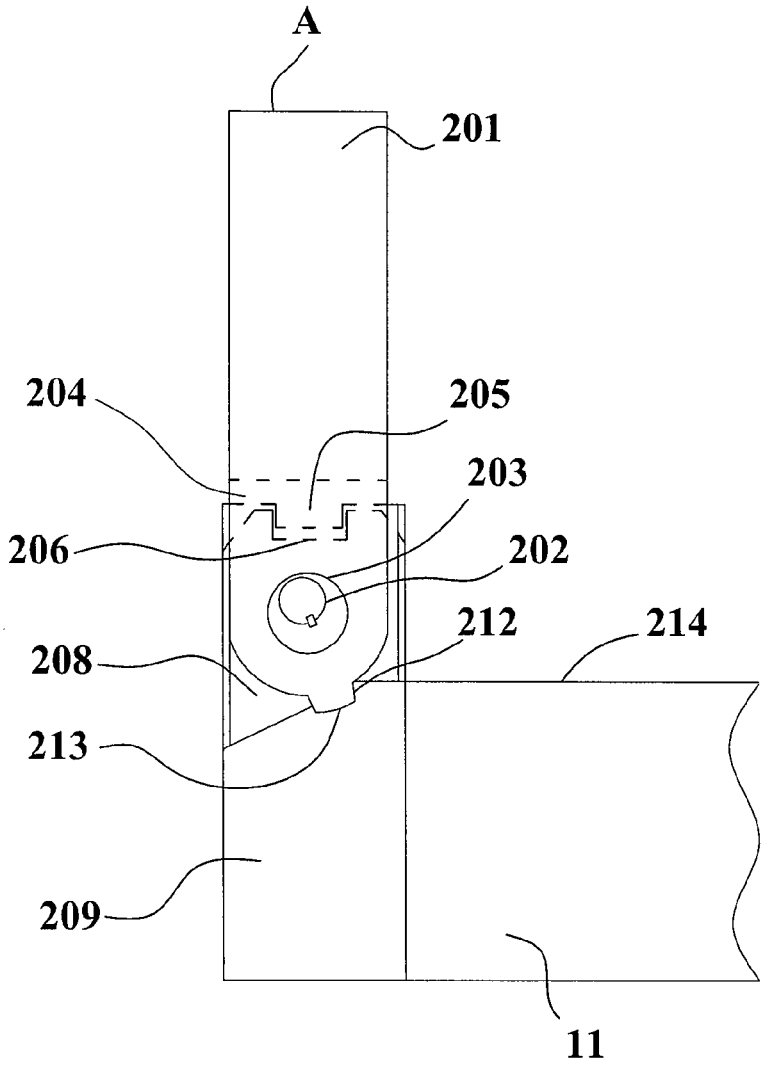
FIG. 3*b* is a side elevation view of the joint assembly of FIG. 3*a* laterally displaced in the downward direction into a locked position.

FIG. 3*a* illustrates support arms 201 (and frame 12) orientated in the first operative position aligned substantially perpendicular to the elongate base 11. Accordingly to the unlocked configuration of FIG. 3*a*, lugs 205, 212 are not engaged in respective troughs 206, 213. Referring to FIG. 3*b*, and via a rotation of cam disk 203 within support arm 201, support frame 12 and arms 201 are displaced laterally in a downward direction towards flared region 209 such that lugs 205, 212 engage in respective troughs 206, 213. Support frame 12 is therefore held in the locked position aligned perpendicular to base 11 and configured for transportation of cargo.

Figure 4A:
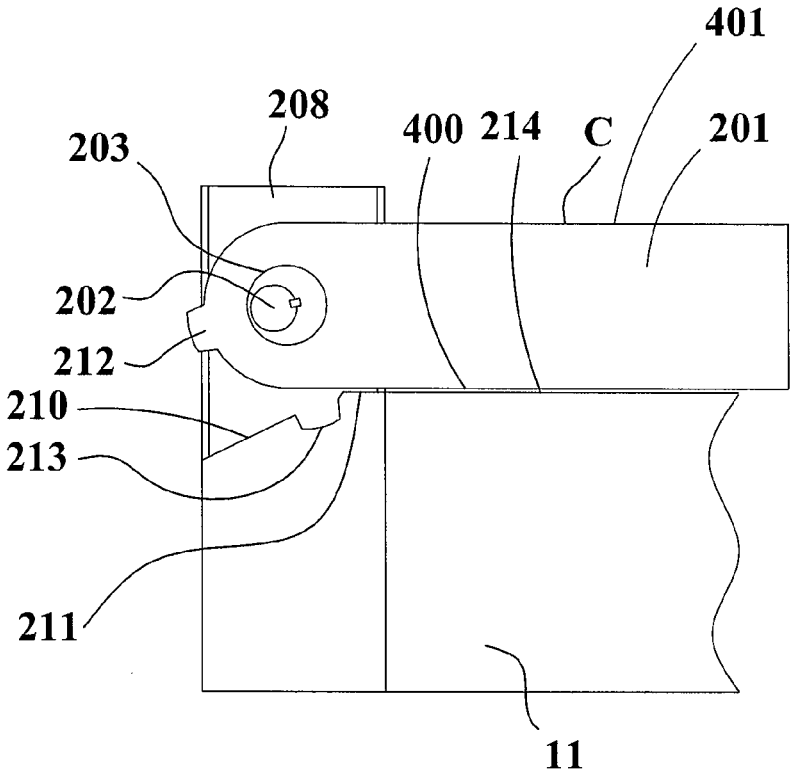
FIG. 4*a* is a side elevation view of the joint assembly of FIG. 3*b* with the support frame orientated in any non-operative position aligned substantially parallel with the base.

Referring to FIG. 4*a*, support arms 201 (and frame 12) is orientated in a non-operative position C aligned substantially parallel with upper surface 214. In this orientation, an inner facing edge 400 of support arms 201 is brought into contact with the upper facing surface 214 of base 11. Frame 12 is further supported in this 'flat' orientation by engagement of abutment surface 211 by the downward facing edges 400 of arms 201. Displacement of support arms 201 and frame 12 from the upright configuration A of FIG. 3*b* involves firstly lateral displacement of frame 12 upwardly in the vertical direction such that lugs 205, 212 clear respective troughs 206, 213. This is provided by a rotation of cam 203 about pivot pin 202. Frame 12 (via support arms 201) is then pivoted about pin 202 into the non-operative orientation C aligned parallel with plate 11.

Figure 4B:
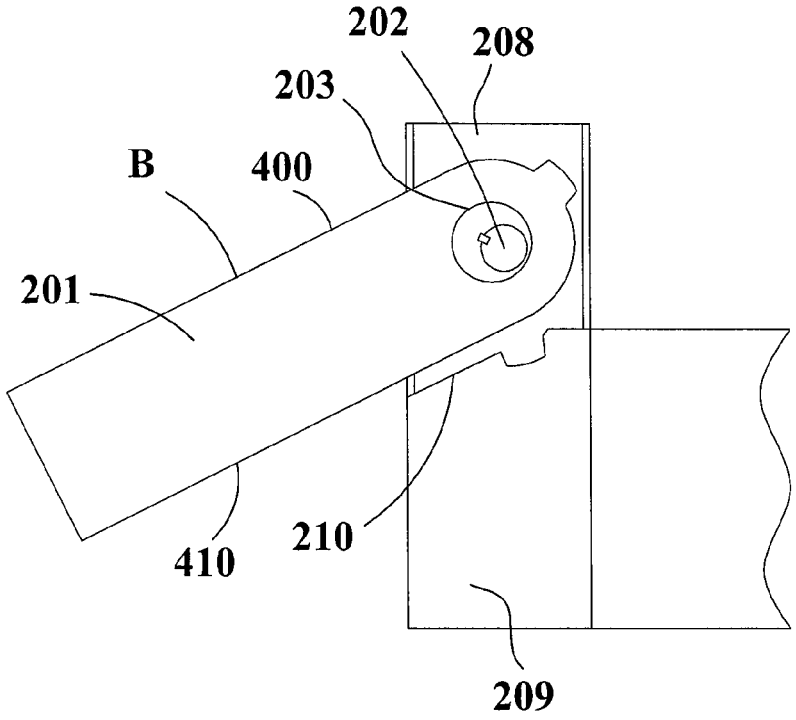
FIG. 4*b* is a side elevation view of the joint assembly of FIG. 4*a* with the support frame extending downwardly and away from the base in a second operative position to provide a ramp over which transported goods may be loaded and unloaded at the platform base.

FIG. 4*b* illustrates support arms 201 (and frame 12) orientated in position B extending downwardly and away from base 11 and in particular upward facing surface 214. In the inclined, angled orientation of FIG. 4*b*, support arms 201 (and frame 12) may be held in this position by engagement with the ground. Further support and control of the range of movement of support arms 201 relative to base 11 is provided by abutment surfaces 210 configured to engage second edges 401 of arms 201 positioned opposed to edges 400. As abutment surfaces 210 are inclined in the downward direction away from uppermost surface 214, frame 12, via pivoting of support arms 201 about pin 202 is configured to extend away in the downward direction below the plane of upper support surface 214. Furthermore, pivoting arms 201 comprising rounded edge regions 215 are capable of pivoting over 180° and beyond between abutment surfaces 211 and 210.

Referring to FIGS. 3*a* and 3*b*, in the load bearing orientation (position A) support arms 201 are configured to transfer both lateral (vertical) and transverse, (including horizontal), loading forces to base 11 via contact between the cooperating load transfer components 205, 204, 207, 215, 212 and 213. That is, in the upwardly extending orientation A, any loading forces applied to support arms 201 (via frame 12) are not borne by the pivot pin 202 and cam arrangement 203. This configuration allows multiple loading platforms 10 to be stacked on top of one another during cargo transportation with support frames 12 orientated in position A.

As will be appreciated by those skilled in the art, the load transfer between support arms 201 and pivot mounting 208, 209 may be provided by alternative means including by way of example, suitable support pins, shoot bolts and the like.

What is claimed is:

1. A transportable load carrying platform comprising:

a base to support a load;

at least one support frame pivotally mounted towards one end of the base, the at least one support frame configured to pivot between at least three positions comprising:

a first operative position in which the support frame extends upwardly and transverse to the base;

a second operative position in which the support frame extends outwardly and downwardly from the base; and an inoperative position in which the support frame extends substantially parallel to the base, the overall height of the platform being reduced in the inoperative position relative to that in the first operative position;

the load carrying platform characterised by:

a cam arrangement comprising a pivot means to mount the support frame at the base and allow the support frame to pivot between the three positions about a pivot axis, the cam arrangement also configured to laterally displace the support frame relative to the base by rotation of the cam arrangement, wherein displacement of the support frame to and from the first operative position in which a first and second cooperative load carrying means are cooperatively engaged comprises pivotal movement about the pivot axis and lateral displacement of the support frame relative to the base; and first and second cooperative load carrying means provided at both the base and the support frame, the respective first load carrying means configured to engage one another and the respective second load carrying means configured to engage one another when the support frame is in the first operative position to lock the support frame at the base and to transfer loading forces from the support frame to the base;

each of the first and second load carrying means at both the support frame and base being spaced apart from one another in an upward direction when the support frame is in the first operative position;

wherein the cam arrangement is positioned between the first and second load carrying means in the upward direction;

wherein the pivot means comprises a pivot pin extending through the base and the support frame; and wherein the pivot pin is mounted eccentrically at the cam arrangement to laterally displace the support frame relative to the pivot axis so as to provide engagement and release of the cooperative load carrying means provided at the base and support frame.

2. The platform as claimed in claim 1 wherein the cam arrangement comprises a substantially disc structure having a bore to receive one end of the pivot pin and mount the support frame at the base.

3. The platform as claimed in claim 2 wherein the cam arrangement is rotatably mounted at the support frame.

4. The platform as claimed in claim 3 further comprising at least one pivot mounting at the base configured to mount the pivot pin and the support frame.

5. The platform as claimed in claim 4 wherein the support frame comprises support arms, the support frame being mounted on the pivot mounting via the support arms.

6. The platform as claimed in claim 5 wherein the first load carrying means of the support frame comprises a lug and the corresponding first load carrying means of the base comprises a trough configured to receive the lug.

7. The platform as claimed in claim 1 wherein the second load carrying means of the support frame comprises a pair of lugs and the corresponding second load carrying means of the base comprises a pair of troughs configured to receive the respective pair of lugs, the first load carrying means being positioned above the second load carrying means when the support frame is orientated in the first operative position.

8. The platform as claimed in claim 1 wherein the base comprises a second abutment surface to engage and support the support frame in the second operative position.

9. The platform as claimed in claim 8 wherein the base comprises a first abutment surface to engage and support the support frame in the inoperative position.

10. The platform as claimed in claim 9 wherein the second abutment surface is aligned transverse to the first abutment surface.

11. The platform as claimed in claim 1 comprising means to rotate the cam arrangement to laterally displace the support frame relative to the pivot axis.

12. The platform as claimed in claim 10 wherein the second abutment surface is aligned transverse to an upward facing surface of the base.

13. The platform as claimed in claim 1 wherein the overall height of the platform is reduced in the inoperative position relative to that in the second operative position.

* * * * *